US006712105B1

(12) United States Patent
Cannon et al.

(10) Patent No.: US 6,712,105 B1
(45) Date of Patent: Mar. 30, 2004

(54) METHOD AND APPARATUS FOR PLANING AN ARTICLE OF WOOD

(75) Inventors: Edwin O. Cannon, Conway, SC (US); Thomas Charles Hinchliff, Sherwood, OR (US)

(73) Assignee: Key Knife, Inc., Tualatin, OR (US)

( * ) Notice: Subject to any disclaimer, the term of this patent is extended or adjusted under 35 U.S.C. 154(b) by 0 days.

(21) Appl. No.: 10/256,571

(22) Filed: Sep. 26, 2002

(51) Int. Cl.[7] ..... B27C 5/00

(52) U.S. Cl. ..... 144/223; 144/222; 144/39; 144/228; 144/218; 144/231; 144/235; 407/46; 407/101

(58) Field of Search ..... 144/39, 218, 176, 144/223, 225, 228, 231, 235, 222, 220; 407/35, 36, 37, 40, 41, 46, 95, 101, 104, 43

(56) References Cited

U.S. PATENT DOCUMENTS

| | | | | |
|---|---|---|---|---|
| 171,397 A | * | 12/1875 | Margedant | 144/228 |
| 686,548 A | * | 11/1901 | Seymour | 144/223 |
| 821,654 A | * | 5/1906 | Leclair | 144/228 |
| 1,222,871 A | | 4/1917 | Jesseph | |
| 3,780,778 A | * | 12/1973 | Chapman | 144/39 |
| 3,976,112 A | | 8/1976 | Rowlson et al. | |
| 4,269,244 A | * | 5/1981 | Kinsella | 144/218 |
| 4,327,789 A | | 5/1982 | Reuter | |
| 4,335,767 A | | 6/1982 | Reuter | |
| 4,848,427 A | | 7/1989 | Reuter | |
| 5,421,386 A | | 6/1995 | Lundstrom | |
| 5,613,538 A | * | 3/1997 | Brisson | 144/228 |
| 5,617,908 A | | 4/1997 | Toogood | |
| 5,709,255 A | | 1/1998 | Toogood | |
| 5,816,301 A | | 10/1998 | Stager | |
| 6,058,992 A | | 5/2000 | Stager et al. | |
| 6,167,929 B1 | | 1/2001 | Stager et al. | |

FOREIGN PATENT DOCUMENTS

| | | |
|---|---|---|
| DE | 3208377 A1 | 10/1983 |
| DE | 44 19 324 A1 | 6/1994 |
| EP | 0 273 914 | 10/1986 |
| EP | 0 663 272 B1 | 12/1994 |
| EP | 95 02104 | 2/1995 |
| EP | 0 744 255 A2 | 6/1996 |
| FR | 79 22107 | 9/1979 |
| FR | 79 22108 | 12/1979 |
| FR | 81 22198 | 11/1981 |
| WO | WO 92/22402 | 12/1992 |

* cited by examiner

*Primary Examiner*—W. Donald Bray
(74) *Attorney, Agent, or Firm*—Birdwell & Janke, LLP

(57) ABSTRACT

A method and apparatus for planing an article of wood. Specifically disclosed is a cutting head adapted for rotation about an axis, and at least one elongate knife including a linear cutting edge for cutting the wood. The cutting edge terminates at opposite ends of the knife in respective tips. The knife is held by the cutting head so that each tip is rotated about the axis of rotation at the same fixed radius. However, the cutting edge is misaligned by a predetermined bias angle with respect to the axis of rotation. Where a plurality of the cutting heads are stacked or ganged together, preferably, the angle of misalignment for the knives of some of the cutting heads is reversed from the angle of misalignment for the knives of others of the cutting heads.

10 Claims, 5 Drawing Sheets

Fig. 3
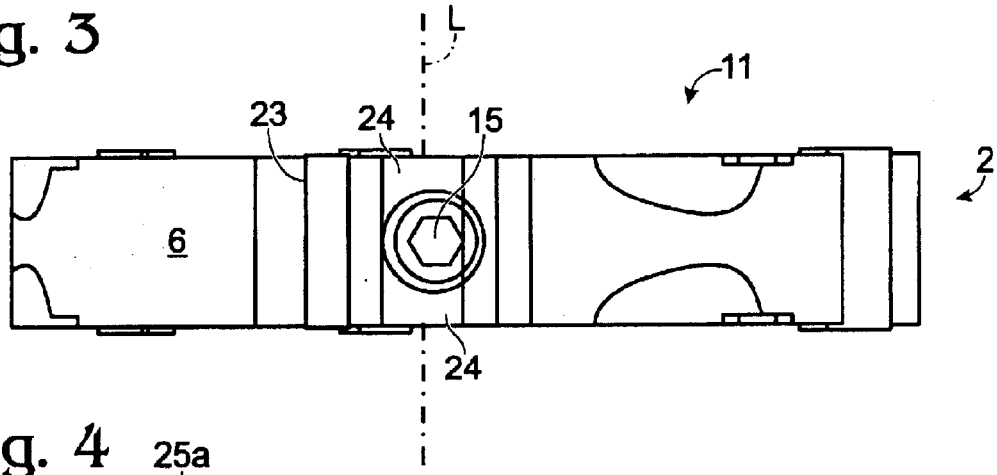
Fig. 4
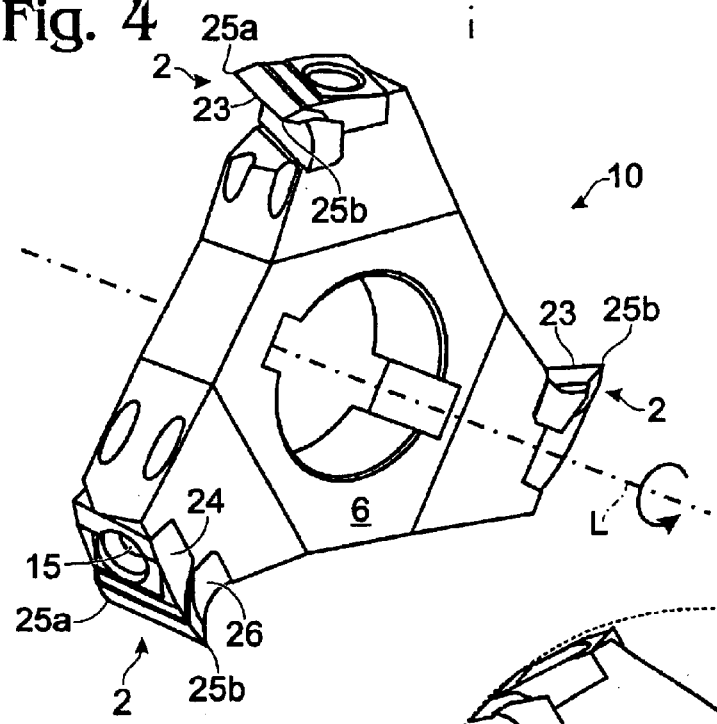
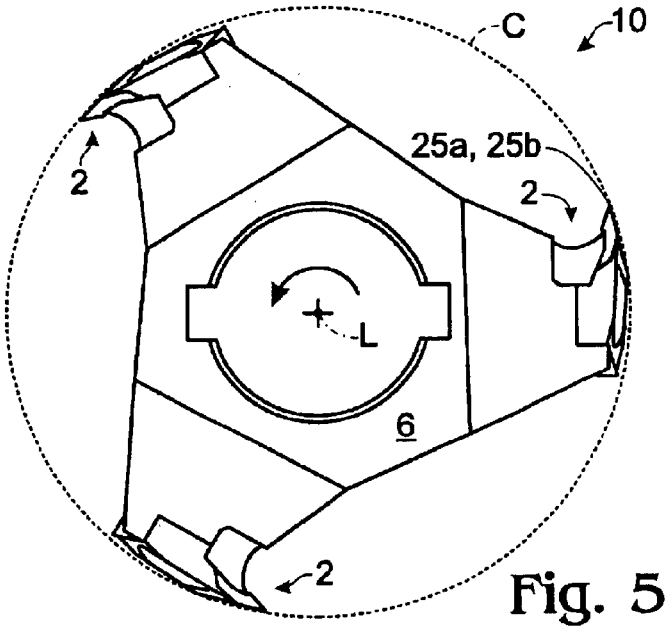
Fig. 5

METHOD AND APPARATUS FOR PLANING AN ARTICLE OF WOOD

FIELD OF THE INVENTION

The present invention relates to a method and apparatus for planing an article of wood, such as may be used for planing logs or cut lumber in a lumber mill.

BACKGROUND OF THE INVENTION

Wood that is first obtained in the form of logs generally must be processed to provide finished lumber for use in construction. One step that is often necessary is to plane the surface of the log or the cut lumber. This may be a secondary, finishing process, but is often an aspect of the primary process in which cutting chips are removed from raw logs.

Planing apparatus typically employ drum-style surfacing or chipping heads, herein "cutting heads," which include a rotating cylinder on which is mounted a plurality of knives for cutting the surface of the wood, which may be lumber or logs. The wood is fed while supported on a horizontal support surface along a generally horizontal path that results in the grazing of the top surface of the wood by the knives. Wood chips or finer particulates are thereby removed from the top surface of the wood to a predetermined depth.

Each knife is typically clamped in the apparatus between an outer clamping member and an inner clamping member or counterknife, wherein the knife and counterknife together form a surface against which the log is forced in order to remove the wood chips. The knife has a cutting edge that is parallel to the axis of rotation of the cutting head.

In a specific process known as "profiling," curved or wany edges of raw logs are removed, and it is preferable that this process also leave behind flat surfaces of smooth finish. The profiling head cuts a corner that extends along the length of the log and that defines an outer side of one board and at least part of the upper or lower face of an adjacent board. To cut the corner, the profiling head rotates about an axis and has cutting surfaces oriented at right angles with respect to each other.

The profiling head may include a knife for planing the aforementioned upper or lower face in the example given above, the cutting head of the knife cutting a plane that is parallel to the axis of rotation of the cutting head ("facing cut") for cutting the aforementioned face, and a saw or knife for cutting the aforementioned outer side ("slicing cut"), which defines a plane that is perpendicular to the axis of rotation. The requirements for the knife or knives employed for the facing cut in the profiling head may be the same or similar to the requirements for the knife or knives employed in the generalized cutting head.

It is desirable in planing to obtain the best surface finish possible. For example, lumber is graded according to surface finish, with higher grades being more valuable. However, prior art planing apparatus commonly results in fiber pulling around knots and swirled grain areas that lowers the quality of the surface finish. Sometimes, a knot is pulled entirely out of a piece of lumber as a result of planing, which drastically lowers the value of the piece.

Another problem with prior art planing apparatus is that the cutting heads induce movement of the wood as it is being cut, which also lowers the quality of the surface finish.

On the other hand, it is also desirable to minimize the cost of the planing apparatus, as well as the cost of its maintenance and repair. Accordingly, there is a need for a method and apparatus for planing an article of wood that provides for increased quality of surface finish at low cost.

SUMMARY OF THE INVENTION

The invention disclosed herein is a method and apparatus for planing an article of wood. Within the scope of the invention, there is a cutting head adapted for rotation about an axis, and at least one elongate knife including a linear cutting edge for cutting the wood. The cutting edge terminates at opposite ends of the knife in respective tips. The knife is held by the cutting head so that each tip is rotated about the axis of rotation at the same fixed radius. However, the cutting edge is misaligned by a predetermined bias angle with respect to the axis of rotation. Preferably, for a 1¾–3½" long knife, the angle of misalignment is between about 10 and 25 degrees.

Where a plurality of the cutting heads are stacked or ganged together, preferably, the angle of misalignment for the knives of some of the cutting heads is reversed from the angle of misalignment for the knives of others of the cutting heads.

Therefore, it is a principal object of the present invention to provide a novel and improved method and apparatus for planing an article of wood.

It is another object of the present invention to provide such a method and apparatus that provides for a high quality surface finish.

It is a still another object of the present invention to provide such a method and apparatus that provides such a surface finish at low cost.

The foregoing and other objects, features and advantages of the present invention will be more readily understood upon consideration of the following detailed description of the invention, taken in conjunction with the following drawings.

BRIEF DESCRIPTION OF THE DRAWINGS

FIG. 3 is a top view of the cutting head of FIG. 1.

FIG. 4 is a pictorial view of a cutting head according to the present invention.

FIG. 5 is a side elevation of the cutting head of FIG. 4, corresponding to FIG. 2.

DETAILED DESCRIPTION OF A PREFERRED EMBODIMENT

Figure 1:
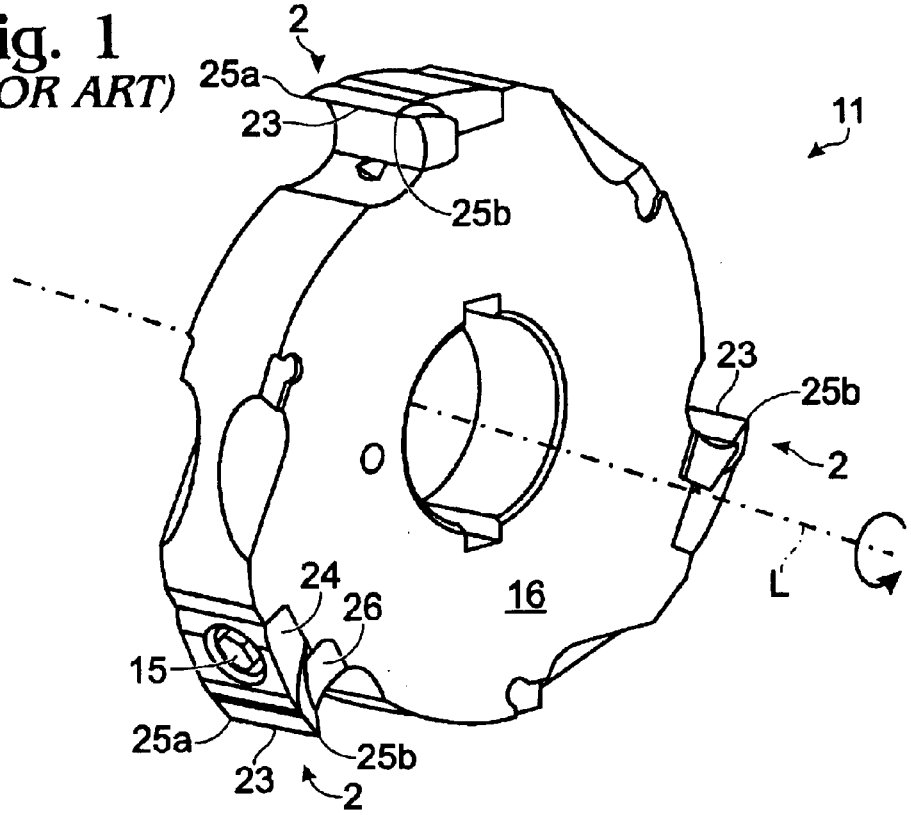
Fig. 1 (PRIOR ART)
FIG. 1 is a pictorial view of a prior art cutting head for planing an article of wood.
Figure 2:
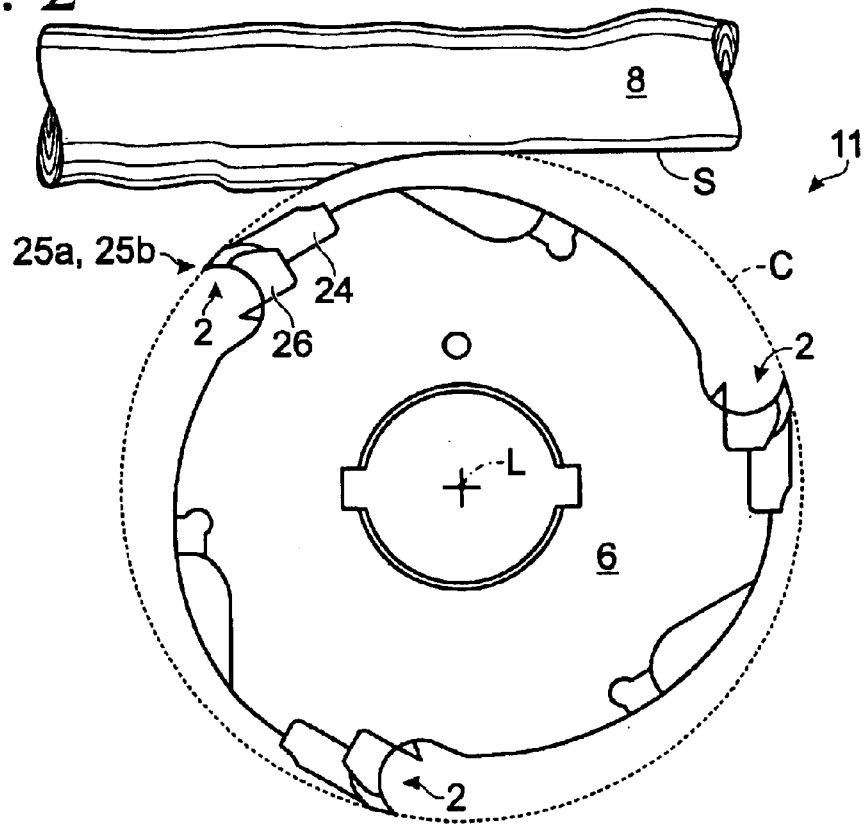
FIG. 2 is a side elevation of the cutting head of FIG. 1, showing the planing of the article of wood.

Referring to FIGS. 1–3, a prior art cutting head 11 for planing an article of wood 8. The apparatus 11 includes a body portion 6 and, for example, three knives 2. The body portion 6 is caused to rotate about an axis of rotation "L," and cutting edges 23 of the knives 2 traverse a cylindrical arc "C" and cut a plane surface "S" in the article of wood as it is moved past the cutting head. The plane surface "S" is parallel to the axis "L."

The knives 2 are elongate and the cutting edges 23 of the knives 2 are linear, having tips 25*a*, 25*b* at opposite ends of the cutting edges. The knives are clamped in the cutting head 11 between upper clamping members 24 and lower clamping members 26 and may be easily removed from the apparatus by removing clamping bolts 15 extending through the clamping members and into the body portion 6.

In the prior art cutting head 11, the knives are held by the cutting head so that the cutting edges 23 are parallel to the axis "L." This causes the cutting edge 23 of each knife to strike the wood bluntly and compressively. It has been determined that this is the cause of some undesirable effects on the surface finish produced by the cutting head. For example, the blunt force applied by the knife to the article of wood shocks the article of wood, causing it to flex and recoil while it is being cut, preventing a smooth, plane finish. Further, harder non-homogeneities in the wood, such as knots and swirled grain areas, are confronted all at once and may be torn out of the softer parts of the wood rather than merely cut.

Figure 6:
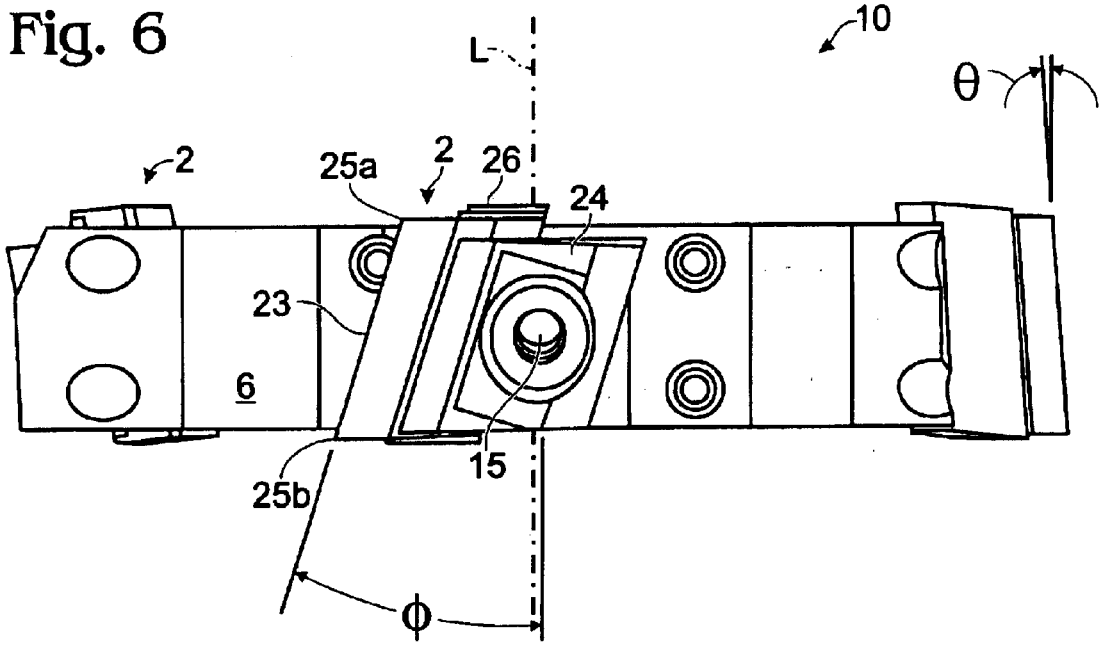
FIG. 6 is a top view of the cutting head of FIG. 1, corresponding to FIG. 3.

Turning now to FIGS. 4–6, a cutting head 10 according to the present invention is shown that solves the aforementioned problems. The cutting head 10 preferably employs any number of conventional knives and clamping members, three sets being shown for direct comparison with FIGS. 1–3. As best seen in FIG. 6, the cutting edges 23 of the knives 2 are held by the clamping members 24, 26 so that each cutting edge makes a bias angle $\phi$ with respect to the axis of rotation "L." The bias angle is defined with reference to FIG. 7.

Figure 7:
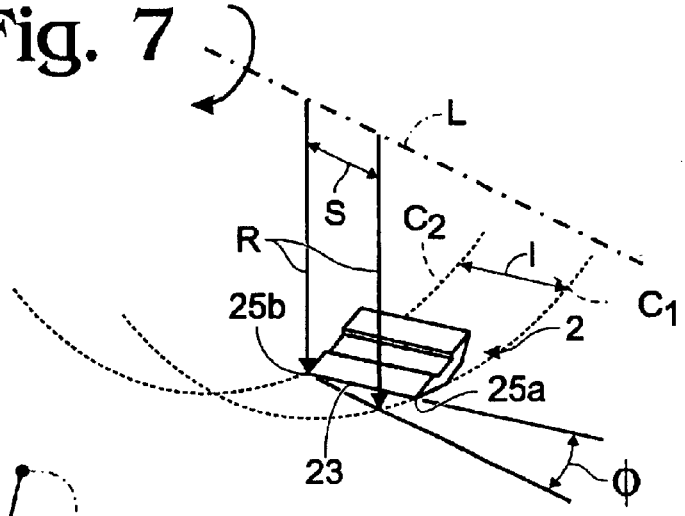
FIG. 7 is a schematic, perspective view of the cutting head of FIGS. 4–6.

FIG. 7 indicates that the head 10 is adapted to hold the knives 2 in place so that each tip 25 is rotated about the axis of rotation at the same fixed radius "R." Thence, the tips 25*a*, 25*b* trace respective circular arcs $C_1$ and $C_2$. The arcs C are axially spaced apart a distance "s," and define a semi-cylindrical axis of revolution. The knife 2 has a length "l," and the cutting edge 23 of the knife is misaligned with the axis "L" by the bias angle $\phi$. The parameters "s," "l," and $\phi$ are related by $s=1\cdot\cos\phi$.

Referring back to FIG. 6, it may be noted that the angle indicated as $\theta$ is merely an artifact of the rotational position of the head 6 about the axis "L," resulting from the fact that the tips 25*a* and 25*b* of the knives 2 reach a given angular position at different times. The angle $\theta$ would be seen to "wobble" between positive and negative maxima as the cutting head rotates.

Figure 8:
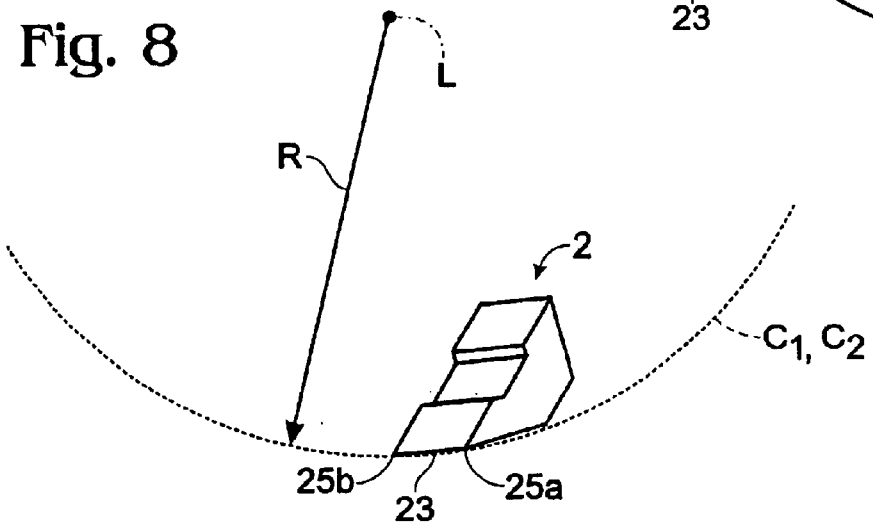
FIG. 8 is a schematic, end view of the cutting head of FIG. 7.

To produce the ideal semi-cylindrical surface of revolution with the cutting edge 23 requires, as the bias angle $\phi$ is increased, increasing amounts of curvature of the cutting edge. Turning to FIG. 8, this requirement may be appreciated by observing that the linear cutting edge 23 only approximates the arcs $C_1$ and $C_2$ in the vicinity of the knife 2. For a given distance "s," a larger bias angle $\phi$ moves the points 25*a* and 25*b* in FIG. 5 farther apart, and the approximation becomes decreasingly valid. However, for a knife having a length "l" of between about 1¾" and 3½," it has been found that about a 10 to 25 degree angle $\phi$ is not too aggressive.

With reference to FIG. 7, assuming that the knife 2 is rotating clockwise, the tip 25*b* will first encounter the article of wood before the tip 25*a*, and first contact is made between the remainder of the cutting edge 23 and the article of wood at sequentially spaced points therebetween, sequentially in time. Moreover, throughout the planing process, the direction of impact of the cutting head on the article of wood will be oblique so that some of the otherwise compressive force applied to the article of wood is converted partially into a shearing force. The bias angle therefore provides the outstanding advantage of substantially reducing mechanical shock to the wood as it first encounters the cutting head, and the shearing action tends to cut rather than pull or lift out hard non-homogeneities in the wood such as knots and swirled grain areas. The result is a much improved surface finish. It is also an outstanding recognition of the present invention that the positive effects of a bias angle can be effectively realized with a knife having a rectilinear rather than a curvilinear cutting edge for bias angles within an appropriate range such as indicated above. This substantially reduces the cost of providing the knife in the first place, both because the knife is less costly to manufacture and because the knife is standard to other types of equipment used in the lumber mill. Moreover, employing standard knives in the cutting head provides for more economical maintenance and repair.

Figure 9:
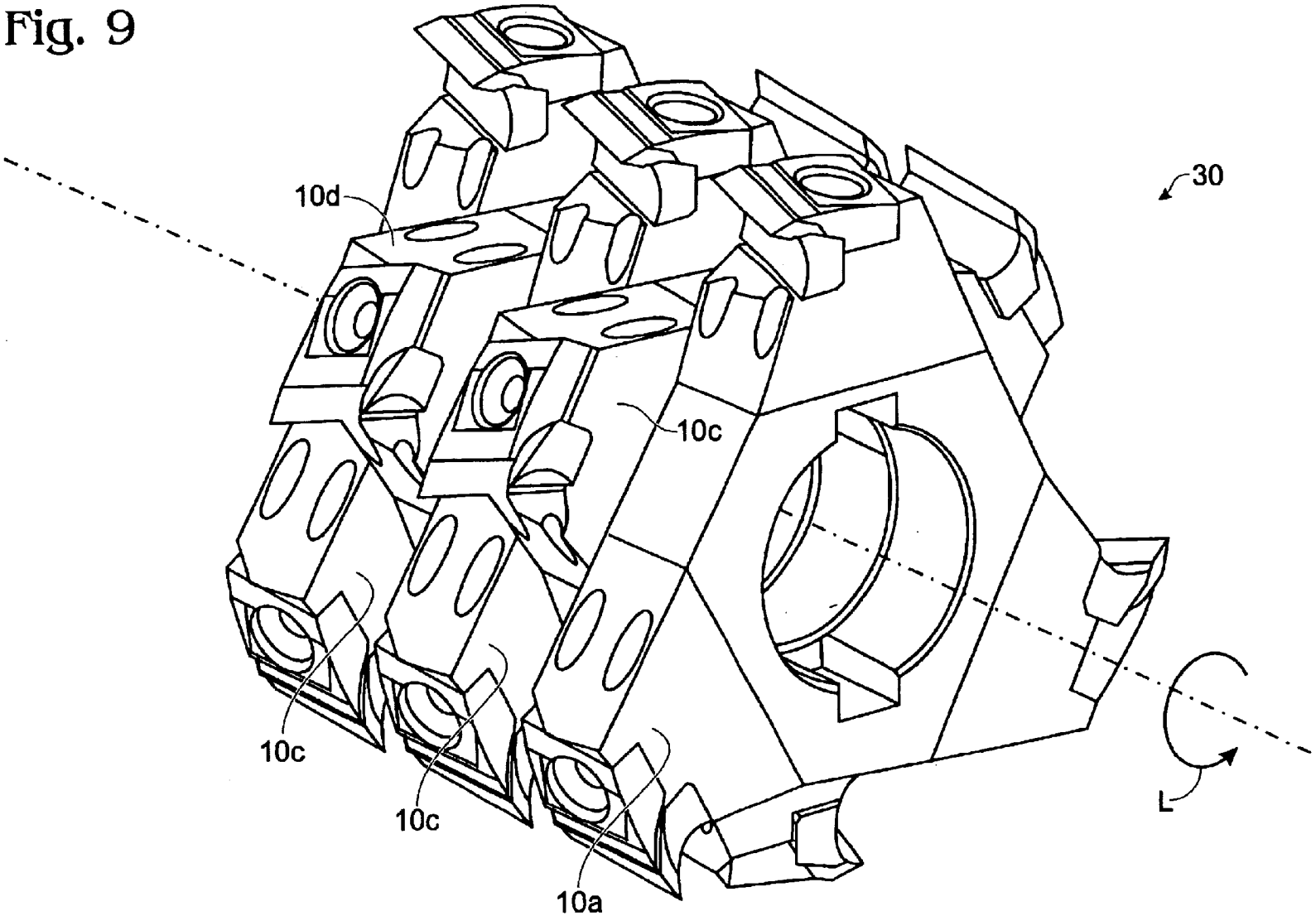
FIG. 9 is a pictorial view of a multiple cutting head according to the present invention.
Figure 11:
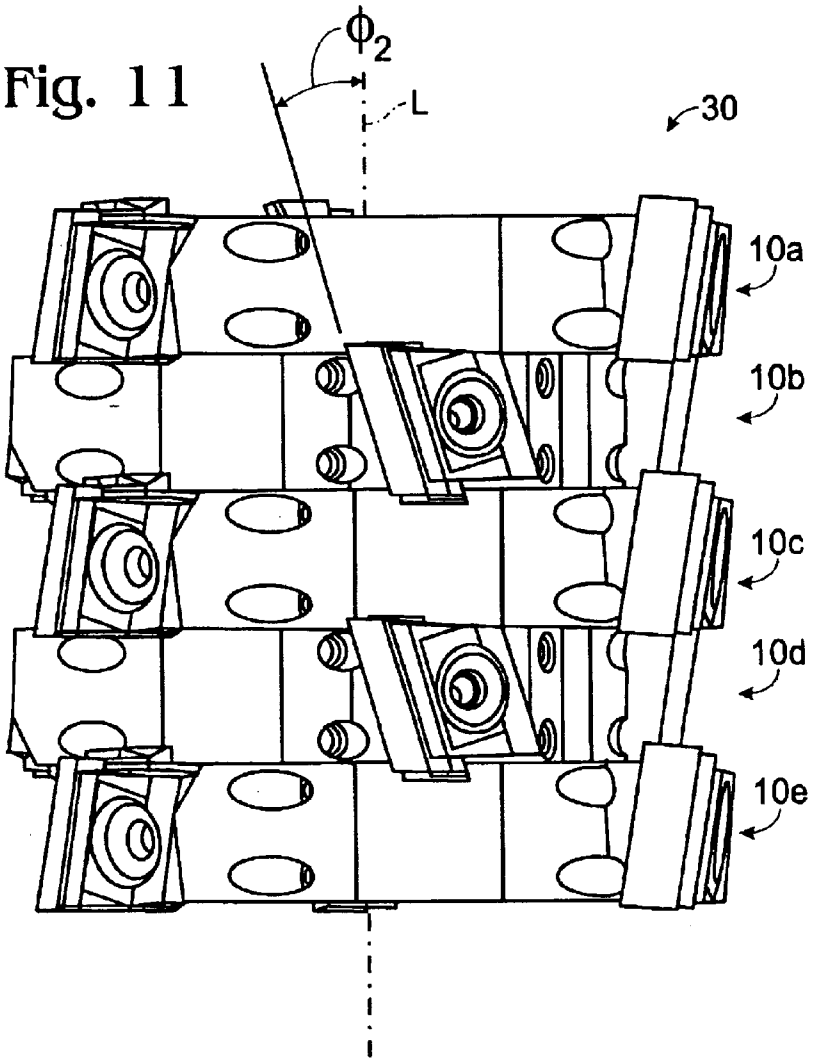
FIG. 11 is a side elevation of the multiple cutting head of FIG. 9, shown rotated about the axis "L" 60 degrees from the first orientation shown in FIG. 10.
Figure 10:
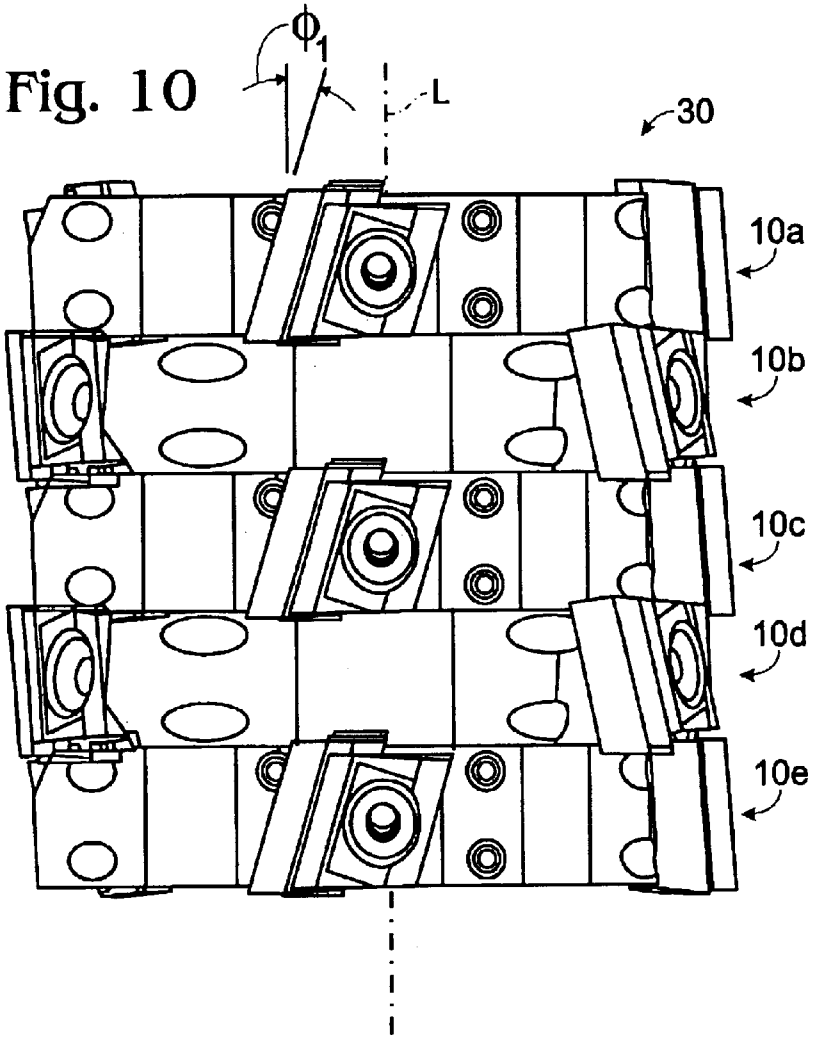
FIG. 10 is a side elevation of the multiple cutting head of FIG. 9 in a first orientation.

Turning to FIGS. 9–11, a multiple cutting head 30 is shown, having multiple instances of the cutting head 10, i.e., 10*a*, 10*b*, 10*c*, 10*d*, and 10*e*, to illustrate another aspect of the invention. It is common to gang together a number of cutting heads in lumber processing apparatus. However, an outstanding feature of the multiple cutting head 30 is that the bias angle $\phi$ is reversed in different cutting heads. For example, the cutting head 10*a* has, e.g., three knives having a bias angle $\phi_1$ (FIG. 10) and the adjacent cutting head 10*b* has a corresponding set of knives having a bias angle $\phi_2$ (FIG. 11), preferably though not necessarily of the same magnitude as the angle $\phi_1$. If the angle $\phi_1$ is considered (arbitrarily) positive, then the angle $\phi_2$ is negative. Continuing down the stack, the cutting head 10*c* employs a set of knives having a positive bias angle, and so on, in alternating fashion. While a specific example of alternating reversal of the bias angle has been shown, the same or similar effect may be produced simply by providing some cutting heads with positive bias angles and other cutting heads with negative bias angles, without regard to the relative positions of the cutting heads in the stack. Moreover, bias angles of different magnitudes may be employed in different heads.

The reversing bias angles, however provided, enhance the capability of the multiple cutting head to provide high quality surface finish, by at least partially and potentially completely canceling axially directed forces that may be imparted to the wood by the knives of different cutting heads 10. An odd number of the heads may be employed, and the knives may be staggered so that knives of different heads that would otherwise provide cancellation are staggered so that they impact the wood at different times. However, essentially full cancellation of the axially directed forces may be provided by employing an even number of the cutting heads 10, with bias angles having identical magnitudes that are evenly distributed between positive-going and negative-going inclinations, where the heads are aligned so that corresponding points of the knives of alternate bias angle inclinations impact the wood at the same time.

It is to be recognized that, while a particular method and apparatus for planing an article of wood has been shown and described as preferred, other configurations and methods could be utilized, in addition to those already mentioned, without departing from the principles of the invention.

The terms and expressions which have been employed in the foregoing specification are used therein as terms of description and not of limitation, and there is no intention in the use of such terms and expressions to exclude equivalents of the features shown and described or portions thereof, it being recognized that the scope of the invention is defined and limited only by the claims which follow.

What is claimed is:

1. An apparatus for planing an article of wood, comprising:

a cutting head adapted for rotation about an axis; and at least one elongate knife including a linear cutting edge for cutting the wood, said cutting edge terminating at opposite ends of said knife in respective tips, wherein said knife is held by said cutting head so that each of said tips is rotated about said axis at the same fixed radius, and wherein said cutting edge is misaligned by a predetermined bias angle with respect to the axis of rotation.

2. The apparatus of claim 1, wherein the knife is between about 1¾ and 3½ inches wherein said bias angle is between about 10 and 25 degrees.

3. An apparatus for planing an article of wood, comprising:

a first cutting head adapted for rotation about an axis;

a second cutting head adapted for rotation about said axis;

a first elongate knife including a linear cutting edge for cutting the wood, said cutting edge terminating at opposite ends of said knife in respective tips, wherein said knife is held by said first cutting head so that each of said tips is rotated about said axis at the same fixed radius, and wherein said cutting edge is misaligned by a first predetermined bias angle with respect to the axis of rotation; and a second elongate knife including a linear cutting edge for cutting the wood, said cutting edge of said second knife terminating at opposite ends thereof in respective tips of said cutting edge of said second knife, wherein said second knife is held by said second cutting head so that each of said tips of said second knife is rotated about said axis at the same said fixed radius, and wherein said cutting edge of said second knife is misaligned by a second predetermined bias angle that has an opposite inclination with respect to said first bias angle.

4. The apparatus of claim 3, wherein said first bias angle is substantially equal in magnitude to said second bias angle.

5. The apparatus of claim 4, wherein said first and second knives are each between about 1¾ and 3½ inches long, and wherein said first and second bias angles are each between about 10 and 25 degrees.

6. The apparatus of claim 3, further comprising a third cutting head adapted for rotation about said axis, and a third elongate knife including a linear cutting edge for cutting the wood, said cutting edge of said third knife terminating at opposite ends thereof in respective tips of said cutting edge of said third knife, wherein said third knife is held by said third cutting head so that each of said tips of said third knife is rotated about said axis at the same said fixed radius, and wherein said cutting edge of said third knife is misaligned by a third predetermined bias angle that has an opposite inclination with respect to one of said first or said second bias angles.

7. The apparatus of claim 6, wherein said first cutting head is adjacent said second cutting head, and wherein said first and second bias angles have opposite inclinations.

8. The apparatus of claim 6, wherein said first cutting head is adjacent said second cutting head, and wherein said first and second bias angles have the same inclination.

9. The apparatus of claim 7, wherein said second cutting head is adjacent said third cutting head, and wherein said third bias angle has the same inclination as said first bias angle.

10. The apparatus of claim 7, wherein said second cutting head is adjacent said third cutting head, and wherein said third bias angle has the same inclination as said second bias angle.

* * * * *

UNITED STATES PATENT AND TRADEMARK OFFICE

CERTIFICATE OF CORRECTION

PATENT NO. : 6,712,105 B1 
DATED : March 30, 2004
INVENTOR(S) : Edwin O. Cannon and Thomas Charles Hinchliff It is certified that error appears in the above-identified patent and that said Letters Patent is hereby corrected as shown below:

Column 5,
Line 21, delete "3 1/2 inches" and replace with -- 3 1/2 inches long --.

Signed and Sealed this

Twenty-eighth Day of December, 2004

JON W. DUDAS
*Director of the United States Patent and Trademark Office*